US011136871B2

(12) United States Patent
Zhu et al.

(10) Patent No.: US 11,136,871 B2
(45) Date of Patent: Oct. 5, 2021

(54) METHOD AND DEVICE FOR DEVELOPING SHALE GAS BY TAPERED GRADIENT PRESSURE DROP WITH MULTI-STAGE FRACTURED HORIZONTAL WELL

(71) Applicant: UNIVERSITY OF SCIENCE AND TECHNOLOGY BEIJING, Beijing (CN)

(72) Inventors: Weiyao Zhu, Beijing (CN); Zhiyong Song, Beijing (CN); Jianfa Wu, Beijing (CN); Shou Ma, Beijing (CN); Debin Kong, Beijing (CN); Ming Yue, Beijing (CN); Zhen Chen, Beijing (CN); Yubao Gao, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 0 days.

(21) Appl. No.: 17/149,015

(22) Filed: Jan. 14, 2021

(65) Prior Publication Data

US 2021/0238973 A1 Aug. 5, 2021

(30) Foreign Application Priority Data

Nov. 26, 2020 (CN) ..... 202011344521.0

(51) Int. Cl.

| | |
|---|---|
| ***E21B 43/26*** | (2006.01) |
| ***E21B 43/14*** | (2006.01) |
| ***E21B 47/06*** | (2012.01) |

(52) U.S. Cl.

CPC ..... *E21B 43/26* (2013.01); *E21B 43/14* (2013.01); *E21B 2200/20* (2020.05)

(58) Field of Classification Search

CPC ..... E21B 43/26; E21B 43/267; E21B 49/00; E21B 43/24; E21B 47/00; E21B 41/0092; E21B 43/12; E21B 43/14

See application file for complete search history.

(56) References Cited

FOREIGN PATENT DOCUMENTS

| | | | |
|---|---|---|---|
| CN | 108590634 A | * | 9/2018 |
| CN | 109272845 A | | 1/2019 |
| CN | 109815516 A | | 5/2019 |

OTHER PUBLICATIONS

Xin Cuiping,Bai Huifang,Zhang Lei,et al.Application Study of Multistage Fracturing Horizontal Well Production Forecasting Models for Shale Gas with Different Fracture Forms[J].Unconventional Oil and Gas,2020,(3):65-71.

(Continued)

*Primary Examiner* — Zakiya W Bates
(74) *Attorney, Agent, or Firm* — IPro, PLLC

(57) ABSTRACT

A method for developing shale gas by tapered gradient pressure drop with multi-stage fractured horizontal well is provided and the method comprises: acquiring fracturing crack form parameters of the multi-stage fractured horizontal well and reservoir characteristic parameters of nearby formation; dividing the formation near the shale gas multi-stage fractured horizontal well into strongly transformed area, weakly transformed area and matrix area; establishing pressure difference-flow models of gas-phase and water phase of the three areas respectively, and coupling the models of the three areas to establish production equation of the multi-stage fractured horizontal well; according to the production equation of the multi-stage fractured horizontal well, performing numerical simulation with different combinations of production pressure differences in the three stages of the multi-stage fractured horizontal well; and selecting a combination of production pressure differences (Continued)

with the greatest economic benefit as combination of production pressure differences.

20 Claims, 4 Drawing Sheets

(56) References Cited

OTHER PUBLICATIONS

Xie Wei-yang, Liu Xu-ning, Wu Jian-fa, Zhang Jian, Wu Tian-peng, Chen Man. Production decline characteristic and dynamic monitoring of horizontal well group in shale gas reservoirs[J]. Natural Gas Geoscience, 2019, 30(2): 257 265.

* cited by examiner

METHOD AND DEVICE FOR DEVELOPING SHALE GAS BY TAPERED GRADIENT PRESSURE DROP WITH MULTI-STAGE FRACTURED HORIZONTAL WELL

FIELD OF THE INVENTION

The present disclosure relates to the technical field of shale gas exploitation, in particular to a method and device for developing shale gas by tapered gradient pressure drop with multi-stage fractured horizontal well.

BACKGROUND OF THE INVENTION

Fracturing is an important technology to realize the effective development of shale gas reservoirs. The combination of horizontal well and fracturing technology can greatly increase the contact area between complex crack network and matrix, and achieve the effect of increasing production of shale gas reservoir. In the process of shale gas development, the control for the production pressure difference of multi-stage fractured horizontal well is very important for the later productivity.

SUMMARY OF THE INVENTION

In one aspect, a method for developing shale gas by tapered gradient pressure drop with multi-stage fractured horizontal well is provided. At least one multi-stage fractured horizontal well is provided in the shale gas reservoir. For any one multi-stage fractured horizontal well of the at least one multi-stage fractured horizontal well, the method for developing shale gas by tapered gradient pressure drop with multi-stage fractured horizontal well comprises:

acquiring fracturing crack form parameters of the multi-stage fractured horizontal well and reservoir characteristic parameters of nearby formation;

dividing the formation near the shale gas multi-stage fractured horizontal well into strongly transformed area, weakly transformed area and matrix area according to the fracturing crack form parameters and the reservoir characteristic parameters;

establishing pressure difference-flow models of gas-phase and water phase of the strongly transformed area, pressure difference-flow models of gas-phase and water phase of the weakly transformed area, and pressure difference-flow models of gas-phase and water phase of the matrix area respectively;

coupling the pressure difference-flow models of gas-phase and water phase of the strongly transformed area, the pressure difference-flow models of gas-phase and water phase of the weakly transformed area, and the pressure difference-flow models of gas-phase and water phase of the matrix area, to establish a production equation of the multi-stage fractured horizontal well;

according to the production equation of the multi-stage fractured horizontal well, performing numerical simulation with different combinations of production pressure differences in fracturing fluid reverse discharge stage, high production stage and stable production stage of the multi-stage fractured horizontal well; and drawing gas production curves under different combinations of production pressure differences, and selecting a combination of production pressure differences with the greatest economic benefit as the combination of production pressure differences of the multi-stage fractured horizontal well.

In at least one embodiment of the present disclosure, said performing numerical simulation with different combinations of production pressure differences in fracturing fluid reverse discharge stage, high production stage and stable production stage of the multi-stage fractured horizontal well comprises: performing numerical simulation with multiple combinations of production pressure differences having gradually decreasing bottom hole flow pressure in the fracturing fluid reverse discharge stage, the high production stage and the stable production stage of the multi-stage fractured horizontal well.

In at least one embodiment of the present disclosure, the pressure difference-flow models of gas-phase and water phase of the strongly transformed area are as follows:

the model of gas-phase is:

$$q_{sc1} = \frac{\pi K_{fn} K_{rg1} h Z_{sc} T_{sc}}{p_{sc} T} \frac{p_{fn}^2 - p_{wf}^2}{\ln \frac{r_{fn}}{r_w}},$$

$$R_1 = \frac{p_{sc} T \bar{\mu} \bar{Z}}{\pi K_{fn} K_{rg1} h Z_{sc} T_{sc}} \ln \frac{r_{fn}}{r_w},$$

$$K_{fn} = \sum_{i=1}^{n} \frac{W_i^4 \cos^2 \gamma_i}{12X(W_i + X)} + \sum_{i=1}^{n} \frac{X_i}{W_i + X} K_m,$$

$$r_{fn} = \sqrt{a_{fn} b_{fn}},$$

$$S_w + S_g = 1;$$

and the model of water phase is:

$$p_{fn} - p_{wf} = \frac{\mu_w x_f}{K_{fn} K_{rw1} 2wh} q_w + \frac{4.405 \times 10^{-5}}{(K_{fn} K_{rw1})^{1.105}} \frac{\rho_w x_f}{4w^2 h^2} q_w^2;$$

wherein, $q_{sc1}$ is a flow rate of the gas well of the strongly transformed area under standard condition, $m^3/s$;

$p_{fn}$ is the pressure at the interface of the strongly transformed area and the weakly transformed area, MPa;

$p_{wf}$ is bottom hole flow pressure, MPa;

$K_{fn}$ is the permeability of the crack network of the strongly transformed area, mD;

$K_{rg1}$ is the relative permeability of gas-phase of the strongly transformed area, mD;

$K_m$ is matrix permeability, mD;

h is the thickness of the gas layer, m;

$z_{sc}$ is the gas compression factor under standard condition, dimensionless;

$\bar{Z}$ is the gas compression factor under average pressure condition, dimensionless;

$T_{sc}$ is the temperature under standard condition, K;

T is the temperature under the formation condition, K;

$R_1$ is the equivalent seepage resistance of the strongly transformed area, $MPa \cdot s/m^3$;

$p_{sc}$ is the pressure constant under standard condition, namely, 0.1 MPa;

$\bar{\mu}$ is the gas viscosity under average pressure condition, mPa·s;

$r_w$ is the radius of the gas well, m;

$r_{fn}$ is the equivalent supply radius, m;

$a_{fn}$ is the major axis of the fracturing ellipse of the strongly transformed area, m;

$b_{fn}$ is the minor axis of the fracturing ellipse of the strongly transformed area, m;

X is the average distance between each series of cracks, m;

W is the crack opening, m;

γ is the angle formed by the pressure gradient direction and respective crack direction;

$S_w$ is the water phase saturation, dimensionless;

$S_g$ is the gas-phase saturation, dimensionless;

$\mu_w$ is the viscosity of water, mPa·s;

$x_f$ is the main crack length, m;

$K_{rw1}$ is the relative permeability of water of the strongly transformed area, dimensionless;

w is the crack width, m;

$\rho_{w\ i}$ is the density of water, kg/m$^3$; and $q_w$ is the water flow of the strongly transformed area under standard condition, m$^3$/s;

wherein, the standard condition is the condition that the pressure is 0.1 MPa; and a certain physical quantity under the average pressure condition is the average value of the physical quantity under different pressures within the range of bottom hole pressure variation.

In at least one embodiment of the present disclosure, the pressure difference-flow models of gas-phase and water phase of the weakly transformed area are as follows:

according to the spatial heterogeneity of the fractured weakly transformed area, the permeability of the fractured weakly transformed area is corrected:

$$K_{mf} = \frac{K_{fn} - K_m}{r_{fn} - r_{mf}} r + \left(K_{fn} - \frac{K_{fn} - K_m}{r_{fn} - r_{mf}} r_{fn}\right);$$

the model of gas-phase is:

$$q_{sc2} = \frac{2\pi \frac{(K_{fn} - K_m)K_{rg2}}{r_{mf}} hZ_{sc}T_{sc}(p_{mf}^2 - p_{fn}^2)}{p_{sc}T\bar{\mu}\bar{Z}\left(1 - 1\Big/\sqrt{\frac{2r_{mf}^2 + \sqrt{4r_{mf}^4 + a_{fn}^4}}{a_{fn}^2}}\right)} + \frac{2\pi K_{fn}K_{rg2}hZ_{sc}T_{sc}(p_{mf}^2 - p_{fn}^2)}{p_{sc}T\bar{\mu}\bar{Z}\ln\left(\frac{2r_{mf}^2 + \sqrt{4r_{mf}^4 + a_{fn}^4}}{a_{fn}^2}\right)},$$

$$R_{21} = \frac{p_{sc}T\bar{\mu}\bar{Z}\left(1 - 1\Big/\sqrt{\frac{2r_{mf}^2 + \sqrt{4r_{mf}^4 + a_{fn}^4}}{a_{fn}^2}}\right)}{\pi \frac{(K_{fn} - K_m)K_{rg2}}{r_{mf}} hZ_{sc}T_{sc}},$$

$$R_{22} = \frac{p_{sc}T\bar{\mu}\bar{Z}\ln\left(\frac{2r_{mf}^2 + \sqrt{4r_{mf}^4 + a_{fn}^4}}{a_{fn}^2}\right)}{2\pi K_{fn}K_{rg2}hZ_{sc}T_{sc}},$$

$$r_{mf} = \sqrt{a_{mf}b_{mf}},$$

$$S_w + S_g = 1;$$

and the model of water phase is:

$$p_{mf} - p_{fn} = \frac{q_w\mu_w}{8x_f hK_{mf}K_{rw2}(\arctan(\zeta_{mf}) - \arctan(\zeta_{fn}))} + G_w(\zeta_{mf} - \zeta_{fn});$$

wherein, $q_{sc2}$ is a flow rate of the gas well of the weakly transformed area under standard condition, m$^3$/s;

$p_{fn}$ is the pressure at the interface of the strongly transformed area and the weakly transformed area, MPa;

$p_{mf}$ is the pressure at the interface of the weakly transformed area and the matrix area, MPa;

$K_m$ is the permeability of the matrix area, m$^2$;

$r_{mf}$ is the equivalent supply radius of the weakly transformed area, m;

r is the effective utilization radius, m;

$K_{rg2}$ is the relative permeability of gas-phase of the weakly transformed area, dimensionless;

$R_{21}$ is the additional resistance to consider spatial heterogeneity in the weakly transformed area, MPa s/m$^3$;

$R_{22}$ is the inherent resistance of the weakly transformed area, MPa·s/m$^3$;

$a_{mf}$ is the major axis of the fracturing ellipse of the weakly transformed area, m;

$b_{mf}$ is the minor axis of the fracturing ellipse of the weakly transformed area, m;

$G_w$ is the starting pressure gradient, namely, the pressure gradient at which shale gas starts to flow, MPa/m;

$K_{rw2}$ is the relative permeability of water of the weakly transformed area, dimensionless;

$\zeta_{mf}$ is the value corresponding to $r_{mf}$ in elliptical coordinate system, m; and $\zeta_{fn}$ is the value corresponding to $r_{fn}$ in elliptical coordinate system, m.

In at least one embodiment of the present disclosure, the pressure difference-flow models of gas-phase and water phase of the matrix area are as follows:

the model of gas-phase is:

$$a_e = a_{mf}\left[\frac{1}{2} + \sqrt{\frac{1}{4} + \left(\frac{r_e}{a_{mf}}\right)^4}\right]^{\frac{1}{2}},$$

$$q_{sc3} = \frac{4\pi K_m K_{rg3} hZ_{sc}T_{sc}}{p_{sc}T\bar{\mu}\bar{Z}\ln\left(\frac{2r_e^2 + \sqrt{4r_e^4 + a_e^4}}{a_e^2}\right)} \times \left[\frac{p_e^2 - p_{mf}^2}{2} + \frac{3\pi\alpha\bar{\mu}D}{16K_m K_{rg3}}(p_e - p_{mf})\right],$$

$$R_3 = \frac{p_{sc}T\bar{\mu}\bar{Z}\ln\left(\frac{2r_e^2 + \sqrt{4r_e^4 + a_e^4}}{a_e^2}\right)}{4\pi K_m K_{rg3} hZ_{sc}T_{sc}},$$

$$S_w + S_q = 1;$$

and the model of water phase is:

$$p_e - p_{mf} = \frac{q_w\mu_w}{2\pi hK_m K_{rw3}\ln\frac{r_e}{r_{mf}}} + G_w(r_e - r_{mf});$$

wherein, $q_{sc3}$ is flow rate of the gas well of the matrix area under standard condition, m$^3$/s;

$p_c$ is the pressure outside the matrix area, Mpa;

$a_e$ is the major axis of the matrix ellipse seepage area, m;

$K_{rg3}$ is the relative permeability of gas-phase of the matrix area, dimensionless;

$r_e$ is the exploiting radius of the gas well, m;

D is the diffusion coefficient, $cm^2/s$;

$\alpha$ represents the correction coefficient related to the Knudsen number $K_n$, and $\alpha=0(0\leq K_n<0.001)$, $\alpha=1.2(0.001\leq K_n<0.1)$, $\alpha=1.34(0.1\leq K_n<10)$; and $K_{rw3}$ is the relative permeability of water of the matrix area, dimensionless.

In at least one embodiment of the present disclosure, said coupling the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of the multi-stage fractured horizontal well comprises: coupling the pressure difference-flow models of gas-phase and water phase of the strongly transformed area, the pressure difference-flow models of gas-phase and water phase of the weakly transformed area and the pressure difference-flow models of gas-phase and water phase of the matrix area by equal seepage resistance method, and establishing the production equation of the multi-stage fractured horizontal well based on the diffusion and desorption of the shale gas reservoir.

In at least one embodiment of the present disclosure, the production equation of the multi-stage fractured horizontal well is as follows:

the model of gas-phase is $$q_{sc}=\frac{p_e^2-p_{wf}^2}{R_1+R_2+2R_3}+\frac{2A(p_e-p_{mf})}{R_1+R_2+2R_3}+\frac{2R_3q_d}{R_1+R_2+2R_3},$$

$$p_{mf}=\frac{-A(R_1+R_2)+\sqrt{A^2(R_1+R_2)^2+B(R_1+R_2+2R_3)}}{R_1+R_2+2R_3},$$

$$R_2=\frac{R_{21}R_{22}}{R_{21}+R_{22}},$$

$$A=\frac{3\pi\alpha\mu D}{16K_m},$$

$$B=(R_1+R_2)p_e^2+2A(R_1+R_2)p_e+2R_3p_{wf}^2+2R_3q_d(R_1+R_2),$$

$$q_d=\pi(r_e^2-r_w^2)h\rho_m\left(V_m\frac{p_e}{p_L+p_e}-V_m\frac{\bar{p}}{p_L+\bar{p}}\right)-\pi(r_e^2-r_w^2)\phi_m;$$

and the model of water phase is $$p_e-p_{wf}=\frac{\mu_w x_f}{K_{fn}K_{rw1}2wh}q_w+\frac{4.405\times10^{-5}}{(K_{fn}K_{rw1})^{1.105}}\frac{\rho_w x_f}{4w^2h^2}q_w^2\frac{q_w\mu_w}{8x_fhK_{mf}K_{rw2}(\arctan(\zeta_{mf})-\arctan(\zeta_{fn}))}+G_w(\zeta_{mf}-\zeta_{fn})+\frac{q_w\mu_w}{2\pi hK_mK_{rw3}\ln\frac{r_e}{r_{mf}}}+G_w(r_e-r_{mf});$$

wherein, $q_d$ is the desorption gas volume of the matrix, $m^3/s$;

$q_{sc}$ is the gas well flow rate after coupling the three areas, $m^3/s$;

$\rho_m$ is the rock skeleton density, $kg/m^3$;

$r_w$ is the radius of the gas well, m;

$V_m$ is Langmuir isothermal adsorption constant, $cm^3/g$;

$\phi_m$ is matrix porosity;

$p_L$ is Langmuir pressure constant, MPa; and $\bar{p}$ is average pressure of the formation, MPa.

In at least one embodiment of the present disclosure, the fracturing crack form parameters comprise: main crack length, crack opening, crack width, and the average distance between each series of cracks.

In at least one embodiment of the present disclosure, the reservoir characteristic parameters comprise: temperature under formation condition, gas layer thickness, rock skeleton density, matrix porosity, matrix permeability, average formation pressure, and the pressure outside the matrix area.

In another aspect, a device for developing shale gas by tapered gradient pressure drop with multi-stage fractured horizontal well is provided. The device comprises a processor and a memory. The memory stores computer program instructions suitable for being executed by the processor, and the computer program instructions are executed by the processor to execute one or more steps in the method for developing shale gas by tapered gradient pressure drop with multi-stage fractured horizontal well described in any of the above embodiments.

BRIEF DESCRIPTION OF THE DRAWINGS

The drawings show exemplary embodiments of the present disclosure and, together with the descriptions thereof, are used to explain the principles of the present disclosure, which are included to provide a further understanding of the present disclosure, and are included in and form a part of this specification.

DETAILED DESCRIPTION OF THE INVENTION

Figure 1:
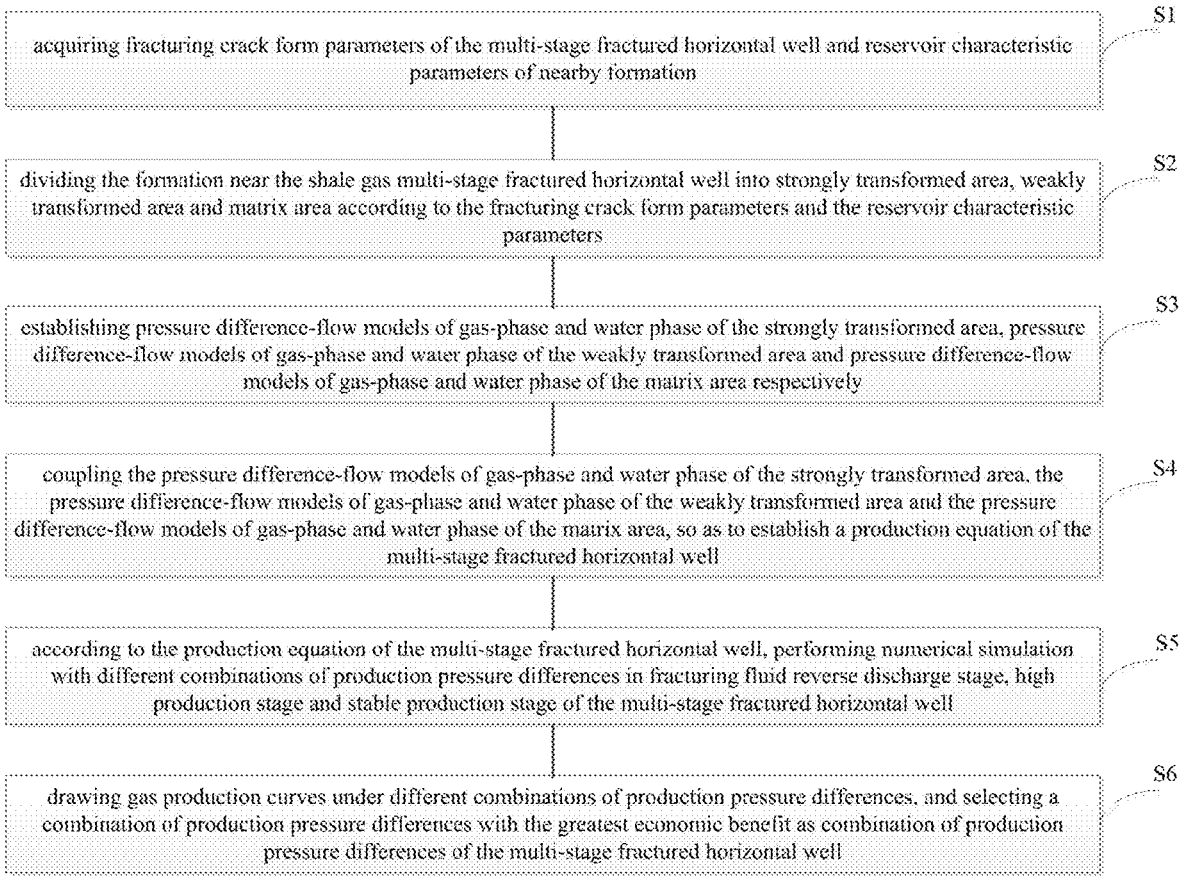
FIG. 1 is a flow diagram of a method for developing shale gas by tapered gradient pressure drop with multi-stage fractured horizontal well according to some embodiments.

The present disclosure will be further described in detail with reference to the accompanying drawings and embodiments. It is understood that the specific embodiments described herein are only for the purpose of explaining the relevant contents, not for the limitation of the present disclosure. In addition, it should be noted that for the convenience of description, only parts related to the present disclosure are shown in the drawings.

It should be noted that the embodiments and features in the present disclosure may be combined with each other without conflict. The present disclosure will be described in detail below with reference to the accompanying drawings and in combination with embodiments.

It should be noted that the step number in the present disclosure is only for the convenience of the explanation of the specific embodiment, and is not used to limit the sequence of steps.

The methods provided by some embodiments of the present disclosure can be executed by related processors, and the following will be explained with the processor as the execution subject. Wherein, the executive subject can be adjusted according to specific cases, such as server, electronic equipment, computer, etc.

The shale gas exploitation stage is divided into three production stages: fracturing fluid reverse discharge stage, high production stage and stable production stage. The inventor of the present disclosure found that the cumulative production of shale gas can be increased by adopting different production pressure differences for the three production stages. If using a more reasonable and accurate mathematical model to simulate the cumulative gas production of shale gas under different combinations of production pressure differences and select the optimal combination of pressure differences, the maximum economic benefit can be achieved.

In the related technologies, the development method of tight gas reservoir is used for reference in the development of shale gas to control the pressure difference, but the effect is not ideal, and the shale gas production decreases rapidly. Foreign shale gas development methods based on their local engineering and experience are not suitable for shale gas development in China. Based on this, in view of the deficiency of pressure difference control in the process of shale gas development in China, some embodiments of the disclosure provide a method and device for developing shale gas by tapered gradient pressure drop with multi-stage fractured horizontal well, so as to maximize the economic benefits of shale gas production.

As shown in FIG. 1, some embodiments of the present disclosure provide a method for developing shale gas by tapered gradient pressure drop with multi-stage fractured horizontal well. At least one multi-stage fractured horizontal well is provided in shale gas reservoir. For any one multi-stage fractured horizontal well of the at least one multi-stage fractured horizontal well, the method for developing shale gas by tapered gradient pressure drop with multi-stage fractured horizontal well includes steps S1~S6.

S1, acquiring fracturing crack form parameters of multi-stage fractured horizontal well and reservoir characteristic parameters of nearby formation.

For example, the fracturing crack form parameters include: main crack length, crack opening, crack width, and average distance between each series of cracks.

For example, reservoir characteristic parameters include: temperature under formation condition, gas layer thickness, rock skeleton density, matrix porosity, matrix permeability, average formation pressure, and pressure outside the matrix area.

S2, dividing the formation near the shale gas multi-stage fractured horizontal well into strongly transformed area, weakly transformed area and matrix area according to the fracturing crack form parameters and reservoir characteristic parameters.

For example, according to the fracturing crack form parameters and reservoir characteristic parameters, actual crack form of the multi-stage fractured horizontal well can be obtained. Considering the characteristics of the shale gas reservoir comprehensively, and according to the seepage theory and the nonlinear seepage effective production theory, the seepage field formed after fracturing of the shale gas reservoir can be simplified into three seepage areas, namely, strongly transformed area, weakly transformed area and matrix area.

Shale reservoir hydraulic fracturing transforming technology makes that the cracks cross and run through with each other, and form a wide range of crack network around the wellbore, thus urge gas to flow to the wellbore. This area is defined as fracturing strongly transformed area. In the strongly transformed area, the gas flows from the cracks to the wellbore. In the weakly transformed area, the gas flows from the crack network to the cracks, and in the matrix area, the gas flows from unfractured area to the crack network.

Figure 2:
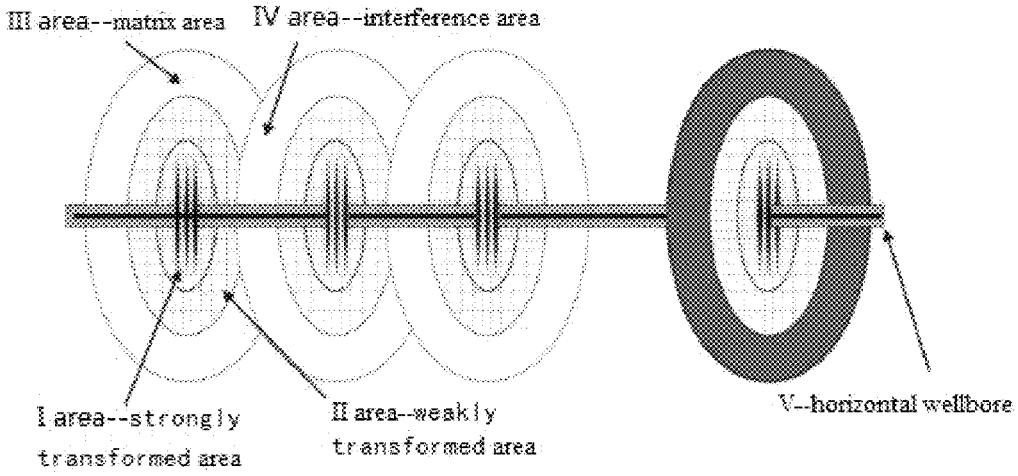
FIG. 2 is a schematic diagram of the strongly transformed area, weakly transformed area, and matrix area of a method for developing shale gas by tapered gradient pressure drop with multi-stage fractured horizontal well according to some embodiments.

As shown in FIG. 2, it shows the three seepage areas (strongly transformed area, weakly transformed area and matrix area) after multi-section three-cluster fracturing (i.e., three clusters of cracks in each fracturing section) by the horizontal well. It can also be seen in FIG. 2 that the overlapping part of the two matrix areas of adjacent fracturing sections can be used as interference area, and there is also a horizontal wellbore area at the horizontal wellbore. The present disclosure ignores the influence of the interference area, thereby simplifying the calculation of the model without affecting the calculation accuracy.

S3, establishing pressure difference-flow models of gas-phase and water phase of the strongly transformed area, pressure difference-flow models of gas-phase and water phase of the weakly transformed area and pressure difference-flow models of gas-phase and water phase of the matrix area respectively.

S4, coupling the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of multi-stage fractured horizontal well.

S5, according to the production equation of multi-stage fractured horizontal well, performing numerical simulation with different combinations of production pressure differences in fracturing fluid reverse discharge stage, high production stage and stable production stage of the multi-stage fractured horizontal well.

S6, drawing gas production curves under different combinations of production pressure differences, and selecting the combination of production pressure differences with the greatest economic benefit as combination of production pressure differences of multi-stage fractured horizontal well.

As an example, for the shale gas reservoir with a pressure outside the matrix area (boundary pressure) of 40 MPa, in the process of numerical simulation, the preset bottom hole flow pressure in the fracturing fluid reverse discharge stage is 20 MPa, then the production pressure difference in the fracturing fluid reverse discharge stage is 20 MPa; the preset bottom hole flow pressure in the high production stage is 15 MPa, then the production pressure difference in the high production stage is 25 MPa; and the preset bottom hole flow pressure in the stable production stage is 10 MPa, then the production pressure difference in the stable production stage is 30 MPa. The production pressure differences 20 MPa, 25 MPa, 30 MPa are adopted respectively in the fracturing fluid reverse discharge stage, high production stage and stable production stage of the multi-stage fractured horizontal well, which is a combination of production pressure differences. In the same way, the production pressure differences 30 MPa, 20 MPa and 10 MPa are adopted respectively in the fracturing fluid reverse discharge stage, high production stage and stable production stage of the multi-stage fractured horizontal well, which is another combination of production pressure differences.

By using different combinations of production pressure differences in the process of numerical simulation, the gas production curves under different combinations of production pressure differences can be obtained. The gas production curve is usually a cumulative gas production curve. Certainly, those skilled in the art can also draw the daily gas production curve, etc. as required, and the embodiments of the present disclosure do not limit this.

Comparing the gas production curves responding to multiple combinations of production pressure differences, and considering the economic benefits and other factors, then the best combination of production pressure differences suitable for the multi-stage fractured horizontal well can be selected.

The method for developing shale gas by tapered gradient pressure drop with multi-stage fractured horizontal well provided by some embodiments of the present disclosure is: based on the relevant theory of seepage mechanics, and by establishing pressure difference-flow models of gas-phase and water phase of the three seepage areas of the shale gas horizontal well after fracturing, coupling these models to obtain the production equation of multi-stage fractured horizontal well, drawing gas production curves under different combinations of production pressure differences used in different production stages through numerical simulation method, and then selecting the best combination of production pressure differences with the best economic benefits and suitable for the multi-stage fractured horizontal well. By this method, the contribution of multi-basin and multi-flow field can be expanded, and the production decline in shale gas production process can be reduced or restrained. After exploiting shale gas by using the method for developing shale gas by tapered gradient pressure drop with multi-stage fractured horizontal well provided by some embodiments of the present disclosure, the formation pressure drop curve is obviously slowed down, the production decline is slowed down and the recovery ratio of shale gas can be greatly improved.

Through the pressure difference-flow models of gas-phase and water phase of the three seepage areas established in the method, it is more convenient to explore the flow characteristics of fluid in shale gas reservoir area. The production equation of multi-stage fractured horizontal well obtained by coupling these models is more suitable for the actual production demand and has higher accuracy, which can provide more accurate theoretical guidance for the field research on the production capacity of multi-stage fractured horizontal wells in shale gas reservoir. On this basis, the design and adjustment of the later production scheme can meet the actual development needs and achieve the enhancement of the recovery ratio.

In some embodiments, said performing numerical simulation with different combinations of production pressure differences in fracturing fluid reverse discharge stage, high production stage and stable production stage of the multi-stage fractured horizontal well includes: performing numerical simulation with multiple combinations of production pressure differences having gradually decreasing bottom hole flow pressure in fracturing fluid reverse discharge stage, high production stage and stable production stage of the multi-stage fractured horizontal well.

By performing numerical simulation with multiple combinations of production pressure differences having gradually decreasing bottom hole flow pressure, the effect of stress sensitivity can be significantly reduced, and it can avoid the situation that the permeability and porosity of the reservoir decrease sharply due to the rapid pressure drop near the well, which is not conducive to the subsequent shale gas production.

As an example, for the shale gas reservoir with a pressure outside the matrix area (boundary pressure) of 30 MPa, in the process of numerical simulation, the preset bottom hole flow pressure in the fracturing fluid reverse discharge stage is 20 MPa, then the production pressure difference in the fracturing fluid reverse discharge stage is 10 MPa; the preset bottom hole flow pressure in the high production stage is 10 MPa, then the production pressure difference in the high production stage is 20 MPa; and the preset bottom hole flow pressure in the stable production stage is 5 MPa, then the production pressure difference in the stable production stage is 25 MPa. The bottom hole flow pressures 20 MPa, 10 MPa, 5 MPa are adopted respectively in the fracturing fluid reverse discharge stage, the high production stage and the stable production stage of multi-stage fractured horizontal well, then the combination of production pressure differences is a combination of production pressure differences having gradually decreasing bottom hole flow pressure.

In some embodiments, the pressure difference-flow models of gas-phase and water phase of the strongly transformed area are as follows.

The model of gas-phase is:

$$q_{sc1} = \frac{\pi K_{fn} K_{rg1} h Z_{sc} T_{sc}}{p_{sc} T} \frac{p_{fn}^2 - p_{wf}^2}{\ln \frac{r_{fn}}{r_w}},$$

$$R_1 = \frac{p_{sc} T \overline{\mu} \overline{Z}}{\pi K_{fn} K_{rg1} h Z_{sc} T_{sc}} \ln \frac{r_{fn}}{r_w},$$

$$K_{fn} = \sum_{i=1}^{n} \frac{W_i^4 \cos^2 \gamma_i}{12X(W_i + X)} + \sum_{i=1}^{n} \frac{X_i}{W_i + X} K_m,$$

$$r_{fn} = \sqrt{a_{fn} b_{fn}},$$

$$S_w + S_g = 1.$$

The model of water phase is:

$$p_{fn} - p_{wf} = \frac{\mu_w x_f}{K_{fn} K_{rw1} 2wh} q_w + \frac{4.405 \times 10^{-5}}{(K_{fn} K_{rw1})^{1.105}} \frac{\rho_w x_f}{4w^2 h^2} q_w^2.$$

Figure 3:
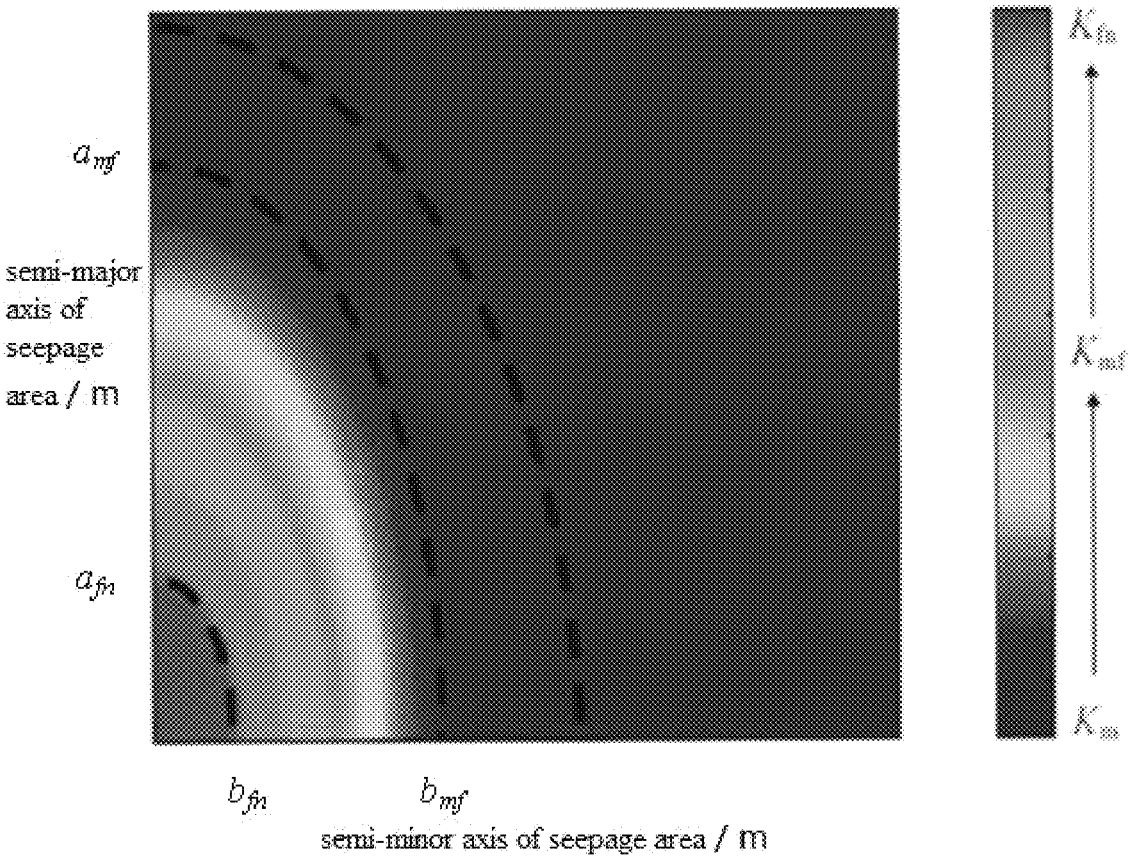
FIG. 3 is a schematic diagram of the semi-major axis and the semi-minor axis of seepage area of a method for developing shale gas by tapered gradient pressure drop with multi-stage fractured horizontal well according to some embodiments.

Wherein, $q_{sc1}$ is flow rate of the gas well of the strongly transformed area under standard condition, $m^3/s$;

$p_{fn}$ is the pressure at the interface of the strongly transformed area and the weakly transformed area, MPa;

$p_{wf}$ is bottom hole flow pressure, MPa;

$K_{fn}$ is the permeability of the crack network of the strongly transformed area, mD;

$K_{rg1}$ is the relative permeability of gas-phase of the strongly transformed area, mD;

$K_m$ is matrix permeability, mD;

h is the thickness of the gas layer, m;

$Z_{sc}$ is the gas compression factor under standard condition, dimensionless;

$\overline{Z}$ is the gas compression factor under average pressure condition, dimensionless;

$T_{sc}$ is the temperature under standard condition, K;

T is the temperature under the formation condition, K;

$R_1$ is the equivalent seepage resistance of the strongly transformed area, MPa·s/m$^3$;

$p_{sc}$ is the pressure constant under standard condition, namely, 0.1 MPa;

$\bar{\mu}$ is the gas viscosity under average pressure condition, mPa·s;

$r_w$ is the radius of the gas well, m;

$r_{fn}$ is the equivalent supply radius, m;

$a_{fn}$ is the major axis of the fracturing ellipse of the strongly transformed area (see FIG. 3), m;

$b_{fn}$ is the minor axis of the fracturing ellipse of the strongly transformed area (see FIG. 3), m;

X is the average distance between each series of cracks, m;

W is the crack opening, m;

γ is the angle formed by the pressure gradient direction and respective crack direction;

$S_w$ is the water phase saturation, dimensionless;

$S_g$ is the gas-phase saturation, dimensionless;

$\mu_w$ is the viscosity of water, mPa·s;

$x_f$ is the main crack length, m;

$K_{rw1}$ is the relative permeability of water of the strongly transformed area, dimensionless;

w is the crack width, m;

$\rho_w$ is the density of water, kg/m$^3$; and $q_w$ is the water flow of the strongly transformed area under standard condition, m$^3$/s;

wherein, the standard condition is the condition that the pressure is 0.1 MPa; and a certain physical quantity under the average pressure condition is the average value of the physical quantity under different pressures within the range of bottom hole pressure variation.

In some embodiments, the pressure difference-flow models of gas-phase and water phase of the weakly transformed area are as follows.

According to the spatial heterogeneity of the fractured weakly transformed area, the permeability of the fractured weakly transformed area is corrected as follows:

$$K_{mf} = \frac{K_{fn} - K_m}{r_{fn} - r_{mf}} r + \left(K_{fn} - \frac{K_{fn} - K_m}{r_{fn} - r_{mf}} r_{fn}\right).$$

The model of gas-phase is:

$$q_{sc2} = \frac{2\pi \frac{(K_{fn} - K_m)K_{rg2}}{r_{mf}} hZ_{sc}T_{sc}(p_{mf}^2 - p_{fn}^2)}{p_{sc}T\bar{\mu}\bar{Z}\left(1 - 1\Big/\sqrt{\frac{2r_{mf}^2 + \sqrt{4r_{mf}^4 + a_{fn}^4}}{a_{fn}^2}}\right)} + \frac{2\pi K_{fn}K_{rg2}hZ_{sc}T_{sc}(p_{mf}^2 - p_{fn}^2)}{p_{sc}T\bar{\mu}\bar{Z}\ln\left(\frac{2r_{mf}^2 + \sqrt{4r_{mf}^4 + a_{fn}^4}}{a_{fn}^2}\right)},$$

$$R_{21} = \frac{p_{sc}T\bar{\mu}\bar{Z}\left(1 - 1\Big/\sqrt{\frac{2r_{mf}^2 + \sqrt{4r_{mf}^4 + a_{fn}^4}}{a_{fn}^2}}\right)}{2\pi \frac{(K_{fn} - K_m)K_{rg2}}{r_{mf}} hZ_{sc}T_{sc}},$$

-continued $$R_{22} = \frac{p_{sc}T\bar{\mu}\bar{Z}\ln\left(\frac{2r_{mf}^2 + \sqrt{4r_{mf}^4 + a_{fn}^4}}{a_{fn}^2}\right)}{2\pi K_{fn}K_{rg2}hZ_{sc}T_{sc}},$$

$$r_{mf} = \sqrt{a_{mf}b_{mf}}\ ,\ S_w + S_g = 1.$$

The model of water phase is:

$$p_{mf} - p_{fn} = \frac{q_w\mu_w}{8x_f hK_{mf}K_{rw2}(\arctan(\zeta_{mf}) - \arctan(\zeta_{fn}))} + G_w(\zeta_{mf} - \zeta_{fn}).$$

Wherein, $q_{sc2}$ is flow rate of the gas well of the weakly transformed area under standard condition, m$^3$/s;

$p_{fn}$ is the pressure at the interface of the strongly transformed area and the weakly transformed area, MPa;

$p_{mf}$ is the pressure at the interface of the weakly transformed area and the matrix area, MPa;

$K_m$ is the permeability of the matrix area, m$^2$;

$r_{mf}$ is the equivalent supply radius of the weakly transformed area, m;

r is the effective utilization radius, m;

$K_{rg2}$ is the relative permeability of gas-phase of the weakly transformed area, dimensionless;

$R_{21}$ is the additional resistance to consider spatial heterogeneity in the weakly transformed area, MPa·s/m$^3$;

$R_{22}$ is the inherent resistance of the weakly transformed area, MPa·s/m$^3$;

$a_{mf}$ is the major axis of the fracturing ellipse of the weakly transformed area (see FIG. 3), m;

$b_{mf}$ is the minor axis of the fracturing ellipse of the weakly transformed area (see Figure $^3$), m;

$G_w$ is the starting pressure gradient, namely, the pressure gradient at which shale gas starts to flow, MPa/m;

$K_{rw2}$ is the relative permeability of water of the weakly transformed area, dimensionless;

$\zeta_{mf}$ is the value corresponding to $r_{mf}$ in elliptical coordinate system, m; and $\zeta_{fn}$ is the value corresponding to $r_{fn}$ in elliptical coordinate system, m.

In some embodiments, the pressure difference-flow models of gas-phase and water phase of the matrix area are as follows.

The model of gas-phase is:

$$a_e = a_{mf}\left[\frac{1}{2} + \sqrt{\frac{1}{4} + \left(\frac{r_e}{a_{mf}}\right)^4}\right]^{\frac{1}{2}},$$

$$q_{sc3} = \frac{4\pi K_m K_{rg3}hZ_{sc}T_{sc}}{p_{sc}T\bar{\mu}\bar{Z}\ln\left(\frac{2r_e^2 + \sqrt{4r_e^4 + a_e^4}}{a_e^2}\right)} \times \left[\frac{p_e^2 - p_{mf}^2}{2} + \frac{3\pi\alpha\mu D}{16K_m K_{rg3}}(p_e - p_{mf})\right],$$

$$R_3 = \frac{p_{sc}T\bar{\mu}\bar{Z}\ln\left(\frac{2r_e^2 + \sqrt{4r_e^4 + a_e^4}}{a_e^2}\right)}{4\pi K_m K_{rg3}hZ_{sc}T_{sc}},$$

$$S_w + S_g = 1.$$

The model of water phase is:

$$p_e - p_{mf} = \frac{q_w \mu_w}{2\pi h K_m K_{rw3} \ln \frac{r_e}{r_{mf}}} + G_w(r_e - r_{mf}).$$

Wherein, $q_{sc3}$ is flow rate of the gas well of the matrix area under standard condition, $m^3/s$;

$p_e$ is the pressure outside the matrix area, Mpa;

$a_e$ is the major axis of the matrix ellipse seepage area, m;

$K_{rg3}$ is the relative permeability of gas-phase of the matrix area, dimensionless;

$r_e$ is the exploiting radius of the gas well, m;

D is the diffusion coefficient, $cm^2/s$;

$\alpha$ represents the correction coefficient related to the Knudsen number $K_n$, and $\alpha=0(0 \le K_b < 0.001)$, $\alpha=1.2(0.001 \le K_n < 0.1)$, $\alpha=1.34(0.1 \le K_n < 10)$; and $K_{rw3}$ is the relative permeability of water of the matrix area, dimensionless.

In some embodiments, said coupling the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of multi-stage fractured horizontal well includes: coupling the pressure difference-flow models of gas-phase and water phase of the strongly transformed area, the pressure difference-flow models of gas-phase and water phase of the weakly transformed area and the pressure difference-flow models of gas-phase and water phase of the matrix area by equal seepage resistance method, and establishing the production equation of multi-stage fractured horizontal well based on the diffusion and desorption of the shale gas reservoir.

By using the equal seepage resistance method, that is, according to the water and electricity similitude principle, describing the seepage field with circuit diagram, and then solving the models according to the circuit law, the productivity prediction model of multi-stage fractured horizontal well can be established, and in which the multiple cluster cracks of the horizontal well are produced simultaneously and interfered each other.

In some embodiments, the production equation of multi-stage fractured horizontal well is as follows.

The model of gas-phase is $$q_{sc} = \frac{p_e^2 - p_{wf}^2}{R_1 + R_2 + 2R_3} + \frac{2A(p_e - p_{mf})}{R_1 + R_2 + 2R_3} + \frac{2R_3 q_d}{R_1 + R_2 + 2R_3},$$

$$p_{mf} = \frac{-A(R_1 + R_2) + \sqrt{A^2(R_1 + R_2)^2 + B(R_1 + R_2 + 2R_3)}}{R_1 + R_2 + 2R_3},$$

$$R_2 = \frac{R_{21} R_{22}}{R_{21} + R_{22}},$$

$$A = \frac{3\pi\alpha\mu D}{16 K_m},$$

$$B = (R_1 + R_2)p_e^2 + 2A(R_1 + R_2)p_e + 2R_3 p_{wf}^2 + 2R_3 q_d (R_1 + R_2),$$

$$q_d = \pi(r_e^2 - r_w^2)h\rho_m\left(V_m \frac{p_e}{p_L + p_e} - V_m \frac{\bar{p}}{p_L + \bar{p}}\right) - \pi(r_e^2 - r_w^2)\phi_m.$$

The model of water phase is $$p_e - p_{wf} = \frac{\mu_w x_f}{K_{fn} K_{rw1} 2wh} q_w + \frac{4.405 \times 10^{-5}}{(K_{fn} K_{rw1})^{1.105}} \frac{\rho_w x_f}{4w^2 h^2} q_w^2 \frac{q_w \mu_w}{8 x_f h K_{mf} K_{rw2} (\arctan(\zeta_{mf}) - \arctan(\zeta_{fn}))} + G_w(\zeta_{mf} - \zeta_{fn}) + \frac{q_w \mu_w}{2\pi h K_m K_{rw3} \ln \frac{r_e}{r_{mf}}} + G_w(r_e - r_{mf}).$$

Wherein, $q_d$ is the desorption gas volume of matrix, $m^3/s$;

$q_{sc}$ is the gas well flow rate after coupling the three areas, $m^3/s$;

$\rho_m$ is the rock skeleton density, $kg/m^3$;

$r_w$ is the radius of the gas well, m;

$V_m$ is Langmuir isothermal adsorption constant, $cm^3/g$;

$\phi_m$ is matrix porosity;

$p_L$ is Langmuir pressure constant, MPa; and $\bar{p}$ is average pressure of the formation, MPa.

It should be noted that the method for developing shale gas by tapered gradient pressure drop with multi-stage fractured horizontal well provided by some embodiments of the present disclosure is applicable to both multi-stage fractured horizontal well and single-stage fractured horizontal well.

$$K_{fn} = \sum_{i=1}^{n} \frac{W_i^4 \cos^2 \gamma_i}{12X(W_i + X)} + \sum_{i=1}^{n} \frac{X_i}{W_i + X} K_m;$$

$$K_{mf} = \frac{K_{fn} - K_m}{r_{fn} - r_{mf}} r + \left(K_{fn} - \frac{K_{fn} - K_m}{r_{fn} - r_{mf}} r_{fn}\right).$$

In the above formula of crack network permeability of strongly transformed area and formula of permeability of weakly transformed area, when n=1, it represents single-stage fracturing, and when n>1, it represents multi-stage fracturing. But generally, n is greater than 1, which is determined by the special reservoir condition of shale reservoir and the comprehensive income of drilling and development. Wherein, X is the average cluster distance between each fracture section. The above formulas reflect the influence of multi-stage fracturing and inter cluster interference on permeability.

Taking a multi-stage fractured horizontal well in a gas field in the south of Sichuan Basin as an example, the method for developing shale gas by tapered gradient pressure drop with multi-stage fractured horizontal well provided by some embodiments of the present disclosure is introduced.

The basic parameters related to the multi-stage fractured horizontal well are shown in Table 1.

TABLE 1

| Basic parameters | Value |
|---|---|
| thickness of gas layer h | 30 m |
| bottom hole flow pressure $p_{wf}$ | 5 MPa |
| pressure outside the matrix area $p_e$ | 30 MPa |
| diffusion coefficient D | $8.4067 \times 10^{-7}$ $cm^2/s$ |
| radius of the gas well $r_w$ | 0.1 m |
| exploiting radius of the gas well $r_e$ | 400 m |
| radius of the crack network $r_N$ | 200 m |
| main crack length $x_f$ | 80 m |
| crack opening W | 0.005 m |

TABLE 1-continued

| Basic parameters | Value |
|---|---|
| average distance of each series of cracks X | 1000 μm |
| permeability of matrix $K_m$ | 0.0005 mD |
| permeability of crack network of the strongly transformed area $K_{fn}$ | 500 mD |
| temperature under standard condition $T_{sc}$ | 293 K. |
| pressure constant under standard condition $p_{sc}$ | 0.1 MPa |
| gas compression factor under standard condition $Z_{sc}$ | 1 |
| compression factor Z | 0.9 |
| viscosity μ | 0.027 mPa · s |
| Langmuir pressure $p_L$ | 2.5 MPa |
| formation temperature T | 366.15 K. |
| Langmuir adsorption constant $V_m$ | 3.74 $m^3/g$ |

According to the above parameters, numerical simulation of the pressure difference-flow models of gas-phase and water phase of the strongly transformed area, the pressure difference-flow models of gas-phase and water phase of the weakly transformed area and the pressure difference-flow models of gas-phase and water phase of the matrix area, and the production equation of multi-stage fractured horizontal well are performed.

In the fracturing fluid reverse discharge stage, the high production stage and the stable production stage of the multi-stage fractured horizontal well, numerical simulation with multiple combinations of production pressure differences having gradually decreasing bottom hole flow pressure is performed. Gas production curves under different combinations of production pressure differences are drawn, and the combination of production pressure differences with the greatest economic benefit is selected as combination of production pressure differences of multi-stage fractured horizontal well.

Figure 4:
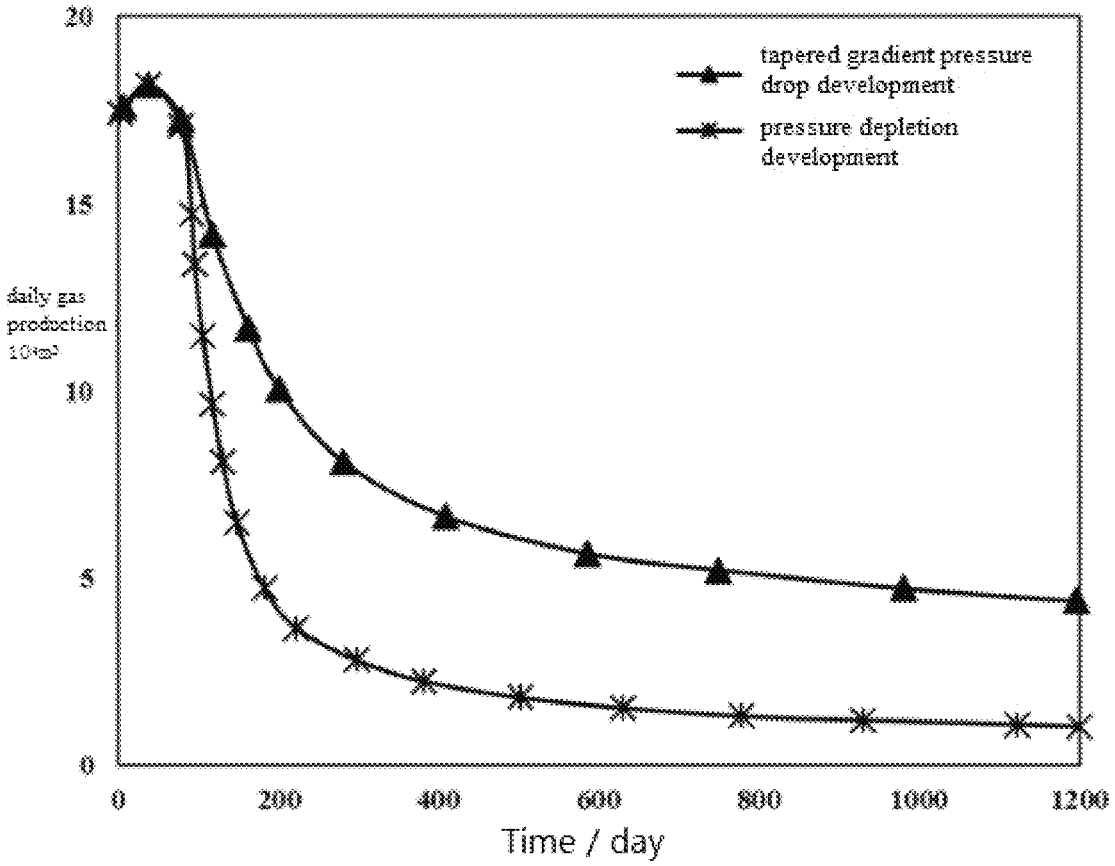
FIG. 4 shows the production comparison between the method for developing shale gas by tapered gradient pressure drop with multi-stage fractured horizontal well and conventional pressure depletion development method according to some embodiments.

FIG. 4 shows the productivity comparison between tapered gradient pressure drop development and pressure depletion development of 1200 days shale gas multi-stage fractured horizontal well calculated according to the above parameters and the production equation of multi-stage fractured horizontal well. It can be seen from the figure that, after exploiting shale gas by the method for developing shale gas by tapered gradient pressure drop with multi-stage fractured horizontal well provided by some embodiments of the present disclosure, the production decline is slowed down significantly, the gas production is significantly higher than that of pressure depletion development, and the recovery ratio of shale gas can be greatly improved.

Some embodiments of the present disclosure also provide a device for developing shale gas by tapered gradient pressure drop with multi-stage fractured horizontal well, which includes a processor and a memory.

The processor is configured to support the device for developing shale gas by tapered gradient pressure drop with multi-stage fractured horizontal well to perform one or more steps in the method for developing shale gas by tapered gradient pressure drop with multi-stage fractured horizontal well described in any of the above embodiments. The processor can be a Central Processing Unit (CPU), or other general purpose processor, Digital Signal Processor (DSP), Application Specific Integrated Circuit (ASIC), Field Programmable Gate Array (FPGA), or other programmable logic components, discrete gate or transistor logic components, discrete hardware components, etc. Among them, the general purpose processor can be a microprocessor or the processor can also be any conventional processor, etc.

The memory stores computer program instructions suitable for being executed by the processor, and the computer program instructions are executed by the processor to execute one or more steps in the method for developing shale gas by tapered gradient pressure drop with multi-stage fractured horizontal well described in any of the above embodiments.

The memory can be Read-Only Memory (ROM) or other types of static storage apparatus that can store static information and instructions, Random Access Memory (RAM) or other types of dynamic storage apparatus that can store information and instructions, or Electrically Erasable Programmable Read-Only Memory (EEPROM), Compact Disc Read Only Memory (CD-ROM) or other optical disk storage, optical disc storage (including compressed optical disc, laser optical disc, optical disc, digital universal optical disc, Blue ray disc, etc.), disk storage medium or other magnetic storage device, or any other medium that can be used to carry or store the desired program code in the form of instruction or data structure and can be accessed by computer, but not limited to these. The memory can exist independently and be connected with processor through communication bus. The memory can also be integrated with the processor.

In the description of this specification, the description of the terms "one embodiment/mode", "some embodiments/modes", "examples", "specific examples", or "some examples" means that the specific features, structures, materials, or characteristics described in connection with the embodiment/mode or example are included in at least one embodiment/mode or example of the present application. In this specification, the schematic expression of the above terms does not necessarily refer to the same embodiment/mode or example. Moreover, the specific features, structures, materials, or characteristics described can be combined in any suitable manner in any one or more embodiments/modes or examples. In addition, without contradicting each other, those skilled in the art may combine different embodiments/modes or examples and features of the different embodiments/modes or examples described in this specification.

In addition, in the description of the present disclosure, "multiple" means at least two, such as two, three, etc., unless otherwise explicitly and specifically defined. "And/or" only describes the association relationship of the associated objects, and represents three kinds of relationships, for example, A and/or B, which are expressed as: A exists alone, A and B exist at the same time, and B exists alone. The terms "up", "down", "left", "right", "inside" and "outside", etc., indicate the orientation or position relationship based on the attached drawings, which is only for the convenience of describing the invention and simplifying the description, rather than indicating or implying that the device or element referred to must have a specific orientation, or be constructed and operated in a specific orientation, and therefore cannot be understood as a restriction to the present disclosure. At the same time, in the description of the present disclosure, the terms "connect" and "connection" should be understood in a broad sense, for example, they can be fixed connection, detachable connection, or integrated connection; they can be mechanical connection or electrical connection; they can be direct connection or indirect connection through intermediate media. For those of ordinary skill in the art, the specific meaning of the above terms in the present disclosure can be understood according to specific circumstances.

Those skilled in the art should understand that the above-mentioned embodiments are only for clearly illustrating the present disclosure, rather than limiting the scope of the present disclosure. For those skilled in the art, other changes or modifications can be made on the basis of the above disclosure, and these changes or modifications are still within the scope of the present disclosure.

The invention claimed is:

1. A method for developing shale gas by tapered gradient pressure drop with multi-stage fractured horizontal well, characterized in that, at least one multi-stage fractured horizontal well is provided in shale gas reservoir, and for any one multi-stage fractured horizontal well of the at least one multi-stage fractured horizontal well, the method for developing shale gas by tapered gradient pressure drop with multi-stage fractured horizontal well comprises:

acquiring fracturing crack form parameters of the multi-stage fractured horizontal well and reservoir characteristic parameters of nearby formation;

dividing the formation near the shale gas multi-stage fractured horizontal well into strongly transformed area, weakly transformed area and matrix area according to the fracturing crack form parameters and the reservoir characteristic parameters;

establishing pressure difference-flow models of gas-phase and water phase of the strongly transformed area, pressure difference-flow models of gas-phase and water phase of the weakly transformed area and pressure difference-flow models of gas-phase and water phase of the matrix area respectively;

coupling the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of the multi-stage fractured horizontal well;

according to the production equation of the multi-stage fractured horizontal well, performing numerical simulation with different combinations of production pressure differences in fracturing fluid reverse discharge stage, high production stage and stable production stage of the multi-stage fractured horizontal well; and drawing gas production curves under different combinations of production pressure differences, and according to the gas production curves, selecting a combination of production pressure differences as combination of production pressure differences of the multi-stage fractured horizontal well.

2. The method for developing shale gas by tapered gradient pressure drop with multi-stage fractured horizontal well according to claim 1, characterized in that, said performing numerical simulation with different combinations of production pressure differences in fracturing fluid reverse discharge stage, high production stage and stable production stage of the multi-stage fractured horizontal well comprises:

performing numerical simulation with multiple combinations of production pressure differences having gradually decreasing bottom hole flow pressure in the fracturing fluid reverse discharge stage, the high production stage and the stable production stage of the multi-stage fractured horizontal well.

3. The method for developing shale gas by tapered gradient pressure drop with multi-stage fractured horizontal well according to claim 1, characterized in that, the pressure difference-flow models of gas-phase and water phase of the strongly transformed area are as follows:

the model of gas-phase is:

$$q_{sc1} = \frac{\pi K_{fn} K_{rg1} h Z_{sc} T_{sc}}{p_{sc} T} \frac{p_{fn}^2 - p_{wf}^2}{\ln \frac{r_{fn}}{r_w}},$$

$$R_1 = \frac{p_{sc} T \bar{\mu} \bar{Z}}{\pi K_{fn} K_{rg1} h Z_{sc} T_{sc}} \ln \frac{r_{fn}}{r_w},$$

$$K_{fn} = \sum_{i=1}^{n} \frac{W_i^4 \cos^2 \gamma_i}{12X(W_i + X)} + \sum_{i=1}^{n} \frac{X_i}{W_i + X} K_m,$$

$$r_{fn} = \sqrt{a_{fn} b_{fn}},$$

$$S_w + S_g = 1;$$

and the model of water phase is:

$$p_{fn} - p_{wf} = \frac{\mu_w x_f}{K_{fn} K_{rw1} 2wh} q_w + \frac{4.405 \times 10^{-5}}{(K_{fn} K_{rw1})^{1.105}} \frac{\rho_w x_f}{4w^2 h^2} q_w^2;$$

wherein, $q_{sc1}$ is a flow rate of gas well of the strongly transformed area under standard condition, $m^3/s$;

$p_{fn}$ is a pressure at an interface of the strongly transformed area and the weakly transformed area, MPa;

$p_{wf}$ is bottom hole flow pressure, MPa;

$K_{fn}$ is a permeability of crack network of the strongly transformed area, mD;

$K_{rg1}$ is a relative permeability of gas-phase of the strongly transformed area, mD;

$K_m$ is matrix permeability, mD;

h is a thickness of the gas layer, m;

$Z_{sc}$ is a gas compression factor under standard condition, dimensionless;

$\bar{Z}$ is a gas compression factor under average pressure condition, dimensionless;

$T_{sc}$ is a temperature under standard condition, K;

T is a temperature under the formation condition, K;

$R_1$ is an equivalent seepage resistance of the strongly transformed area, $MPa \cdot s/m^3$;

$p_{sc}$ is a pressure constant under standard condition, namely, 0.1 MPa;

$\bar{\mu}$ is a gas viscosity under average pressure condition, mPa·s;

$r_w$ is a radius of the gas well, m;

$r_{fn}$ is an equivalent supply radius, m;

$a_{fn}$ is a major axis of a fracturing ellipse of the strongly transformed area, m;

$b_{fn}$ is a minor axis of the fracturing ellipse of the strongly transformed area, m;

X is an average distance between each series of cracks, m;

W is crack opening, m;

γ is an angle formed by the pressure gradient direction and respective crack direction;

$S_w$ is water phase saturation, dimensionless;

$S_g$ is gas-phase saturation, dimensionless;

$\mu_w$ is the viscosity of water, mPa·s;

$x_f$ is main crack length, m;

$K_{rw1}$ is a relative permeability of water of the strongly transformed area, dimensionless;

w is crack width, m;

$\rho_w$ is density of water, kg/m$^3$; and $q_w$ is a water flow of the strongly transformed area under standard condition, m$^3$/s;

wherein, the standard condition is a condition that the pressure is 0.1 MPa; and a certain physical quantity under the average pressure condition is an average value of the physical quantity under different pressures within the range of bottom hole pressure variation.

4. The method for developing shale gas by tapered gradient pressure drop with multi-stage fractured horizontal well according to claim 3, characterized in that, the pressure difference-flow models of gas-phase and water phase of the weakly transformed area are as follows:

according to spatial heterogeneity of the fractured weakly transformed area, the permeability of the fractured weakly transformed area is corrected:

$$K_{mf} = \frac{K_{fn} - K_m}{r_{fn} - r_{mf}} r + \left(K_{fn} - \frac{K_{fn} - K_m}{r_{fn} - r_{mf}} r_{fn}\right);$$

the model of gas-phase is:

$$q_{sc2} = \frac{2\pi \frac{(K_{fn} - K_m)K_{rg2}}{r_{mf}} hZ_{sc}T_{sc}(p_{mf}^2 - p_{fn}^2)}{p_{sc}T\bar{\mu}\bar{Z}\left(1 - 1\Big/\sqrt{\frac{2r_{mf}^2 + \sqrt{4r_{mf}^4 + a_{fn}^4}}{a_{fn}^2}}\right)} + \frac{2\pi K_{fn}K_{rg2}hZ_{sc}T_{sc}(p_{mf}^2 - p_{fn}^2)}{p_{sc}T\bar{\mu}\bar{Z}\ln\left(\frac{2r_{mf}^2 + \sqrt{4r_{mf}^4 + a_{fn}^4}}{a_{fn}^2}\right)},$$

$$R_{21} = \frac{p_{sc}T\bar{\mu}\bar{Z}\left(1 - 1\Big/\sqrt{\frac{2r_{mf}^2 + \sqrt{4r_{mf}^4 + a_{fn}^4}}{a_{fn}^2}}\right)}{2\pi \frac{(K_{fn} - K_m)K_{rg2}}{r_{mf}} hZ_{sc}T_{sc}},$$

$$R_{22} = \frac{p_{sc}T\bar{\mu}\bar{Z}\ln\left(\frac{2r_{mf}^2 + \sqrt{4r_{mf}^4 + a_{fn}^4}}{a_{fn}^2}\right)}{2\pi K_{fn}K_{rg2}hZ_{sc}T_{sc}},$$

$$r_{mf} = \sqrt{a_{mf}b_{mf}},$$

$$S_w + S_g = 1;$$

and the model of water phase is:

$$p_{mf} - p_{fn} = \frac{q_w\mu_w}{8x_f hK_{mf}K_{rw2}(\arctan(\zeta_{mf}) - \arctan(\zeta_{fn}))} + G_W(\zeta_{mf} - \zeta_{fn});$$

wherein, $q_{sc2}$ is a flow rate of gas well of the weakly transformed area under standard condition, m$^3$/s;

$p_{fn}$ is a pressure at the interface of the strongly transformed area and the weakly transformed area, MPa;

$p_{mf}$ is a pressure at the interface of the weakly transformed area and the matrix area, MPa;

$K_m$ is a permeability of the matrix area, m$^2$;

$r_{mf}$ is an equivalent supply radius of the weakly transformed area, m;

r is an effective utilization radius, m;

$K_{rg2}$ is a relative permeability of gas-phase of the weakly transformed area, dimensionless;

$R_{21}$ is an additional resistance to consider spatial heterogeneity in the weakly transformed area, MPa·s/m$^3$;

$R_{22}$ is an inherent resistance of the weakly transformed area, MPa·s/m$^3$;

$a_{mf}$ is a major axis of a fracturing ellipse of the weakly transformed area, m;

$b_{mf}$ is a minor axis of the fracturing ellipse of the weakly transformed area, m;

$G_w$ is a starting pressure gradient, namely, the pressure gradient at which shale gas starts to flow, MPa/m;

$K_{rw2}$ is a relative permeability of water of the weakly transformed area, dimensionless;

$\zeta_{mf}$ is an value corresponding to $r_{mf}$ in elliptical coordinate system, m; and $\zeta_{fn}$ is an value corresponding to $r_{fn}$ in elliptical coordinate system, m.

5. The method for developing shale gas by tapered gradient pressure drop with multi-stage fractured horizontal well according to claim 4, characterized in that, the pressure difference-flow models of gas-phase and water phase of the matrix area are as follows:

the model of gas-phase is:

$$a_e = a_{mf}\left[\frac{1}{2} + \sqrt{\frac{1}{4} + \left(\frac{r_e}{a_{mf}}\right)^4}\right]^{\frac{1}{2}},$$

$$q_{sc3} = \frac{4\pi K_m K_{rg3} hZ_{sc}T_{sc}}{p_{sc}T\bar{\mu}\bar{Z}\ln\left(\frac{2r_e^2 + \sqrt{4r_e^4 + a_e^4}}{a_e^2}\right)} \times \left[\frac{p_e^2 - p_{mf}^2}{2} + \frac{3\pi\alpha\bar{\mu}D}{16K_m K_{rg3}}(p_e - p_{mf})\right],$$

$$R_3 = \frac{p_{sc}T\bar{\mu}\bar{Z}\ln\left(\frac{2r_e^2 + \sqrt{4r_e^4 + a_e^4}}{a_e^2}\right)}{4\pi K_m K_{rg3} hZ_{sc}T_{sc}},$$

$$S_w + S_g = 1;$$

and the model of water phase is:

$$p_e - p_{mf} = \frac{q_w\mu_w}{2\pi hK_m K_{rw3}\ln\frac{r_e}{r_{mf}}} + G_w(r_e - r_{mf});$$

wherein, $q_{sc3}$ is a flow rate of gas well of the matrix area under standard condition, m$^3$/s;

$p_e$ is a pressure outside the matrix area, Mpa;

$a_e$ is a major axis of a matrix ellipse seepage area, m;

$K_{rg3}$ is a relative permeability of gas-phase of the matrix area, dimensionless;

$r_e$ is an exploiting radius of the gas well, m;

D is a diffusion coefficient, cm$^2$/s;

$\alpha$ represents a correction coefficient related to Knudsen number $K_n$, and $\alpha=0(0\leq K_b<0.001)$, $\alpha=1.2$ $(0.001\leq K_n<0.1)$, $\alpha=1.34(0.1\leq K_n<10)$; and $K_{rw3}$ is a relative permeability of water of the matrix area, dimensionless.

6. The method for developing shale gas by tapered gradient pressure drop with multi-stage fractured horizontal well according to claim 5, characterized in that, said coupling the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of the multi-stage fractured horizontal well comprises:

coupling the pressure difference-flow models of gas-phase and water phase of the strongly transformed area, the pressure difference-flow models of gas-phase and water phase of the weakly transformed area and the pressure difference-flow models of gas-phase and water phase of the matrix area by equal seepage resistance method, and establishing the production equation of the multi-stage fractured horizontal well based on diffusion and desorption of the shale gas reservoir.

7. The method for developing shale gas by tapered gradient pressure drop with multi-stage fractured horizontal well according to claim 6, characterized in that, the production equation of the multi-stage fractured horizontal well is as follows:

the model of gas-phase is $$q_{sc} = \frac{p_e^2 - p_{wf}^2}{R_1 + R_2 + 2R_3} + \frac{2A(p_e - p_{mf})}{R_1 + R_2 + 2R_3} + \frac{2R_3 q_d}{R_1 + R_2 + 2R_3},$$

$$p_{mf} = \frac{-A(R_1 + R_2) + \sqrt{A^2(R_1 + R_2)^2 + B(R_1 + R_2 + 2R_3)}}{R_1 + R_2 + 2R_3},$$

$$R_2 = \frac{R_{21}R_{22}}{R_{21} + R_{22}},$$

$$A = \frac{3\pi\alpha\overline{\mu}D}{16K_m},$$

$$B = (R_1 + R_2)p_e^2 + 2A(R_1 + R_2)p_e + 2R_3 p_{wf}^2 + 2R_3 q_d(R_1 + R_2),$$

$$q_d = \pi(r_e^2 - r_w^2)h\rho_m\left(V_m\frac{p_e}{p_L + p_e} - V_m\frac{\overline{p}}{p_L + \overline{p}}\right) - \pi(r_e^2 - r_w^2)\phi_m;$$

and the model of water phase is $$p_e - p_{wf} = \frac{\mu_w x_f}{K_{fn}K_{rw1}2wh}q_w + \frac{4.405\times10^{-5}}{(K_{fn}K_{rw1})^{1.105}}\frac{\rho_w x_f}{4w^2h^2}q_w^2 + \frac{q_w\mu_w}{8x_f hK_{mf}K_{rw2}(\arctan(\zeta_{mf}) - \arctan(\zeta_{fn}))} + G_w(\zeta_{mf} - \zeta_{fn}) + \frac{q_w\mu_w}{2\pi hK_mK_{rw3}\ln\frac{r_e}{r_{mf}}} + G_w(r_e - r_{mf});$$

wherein, $q_d$ is a desorption gas volume of matrix, $m^3/s$;

$q_{sc}$ is a gas well flow rate after coupling the three areas, $m^3/s$;

$\rho_m$ is rock skeleton density, $kg/m^3$;

$r_w$ is an radius of the gas well, m;

$V_m$ is Langmuir isothermal adsorption constant, $cm^3/g$;

$\phi_m$ is matrix porosity;

$p_L$ is Langmuir pressure constant, MPa; and $\overline{p}$ is an average pressure of the formation, MPa.

8. The method for developing shale gas by tapered gradient pressure drop with multi-stage fractured horizontal well according to claim 1, characterized in that, the fracturing crack form parameters comprise: main crack length, crack opening, crack width, and average distance between each series of cracks.

9. The method for developing shale gas by tapered gradient pressure drop with multi-stage fractured horizontal well according to claim 1, characterized in that, the reservoir characteristic parameters comprise: temperature under formation condition, gas layer thickness, rock skeleton density, matrix porosity, matrix permeability, average formation pressure, and pressure outside the matrix area.

10. The method for developing shale gas by tapered gradient pressure drop with multi-stage fractured horizontal well according to claim 1, characterized in that, said according to the gas production curves, selecting a combination of production pressure differences as combination of production pressure differences of the multi-stage fractured horizontal well comprises:

according to the gas production curves, selecting a combination of production pressure differences corresponding to a gas production curve with maximum cumulative gas production as the combination of production pressure differences of the multi-stage fractured horizontal well.

11. A device for developing shale gas by tapered gradient pressure drop with multi-stage fractured horizontal well, characterized in that, the device comprises: a processor and a memory; the memory stores computer program instructions suitable for being executed by the processor, and the computer program instructions are executed by the processor to:

acquire fracturing crack form parameters of the multi-stage fractured horizontal well and reservoir characteristic parameters of nearby formation;

divide the formation near the shale gas multi-stage fractured horizontal well into strongly transformed area, weakly transformed area and matrix area according to the fracturing crack form parameters and the reservoir characteristic parameters;

establish pressure difference-flow models of gas-phase and water phase of the strongly transformed area, pressure difference-flow models of gas-phase and water phase of the weakly transformed area and pressure difference-flow models of gas-phase and water phase of the matrix area respectively;

couple the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of the multi-stage fractured horizontal well;

according to the production equation of the multi-stage fractured horizontal well, perform numerical simulation with different combinations of production pressure differences in fracturing fluid reverse discharge stage, high production stage and stable production stage of the multi-stage fractured horizontal well; and draw gas production curves under different combinations of production pressure differences, and according to the gas production curves, select a combination of production pressure differences as combination of production pressure differences of the multi-stage fractured horizontal well.

12. The device for developing shale gas by tapered gradient pressure drop with multi-stage fractured horizontal well according to claim 11, characterized in that, said perform numerical simulation with different combinations of production pressure differences in fracturing fluid reverse discharge stage, high production stage and stable production stage of the multi-stage fractured horizontal well comprises:

perform numerical simulation with multiple combinations of production pressure differences having gradually decreasing bottom hole flow pressure in the fracturing fluid reverse discharge stage, the high production stage and the stable production stage of the multi-stage fractured horizontal well.

13. The device for developing shale gas by tapered gradient pressure drop with multi-stage fractured horizontal well according to claim 11, characterized in that, the pressure difference-flow models of gas-phase and water phase of the strongly transformed area are as follows:

the model of gas-phase is:

$$q_{sc1} = \frac{\pi K_{fn} K_{rg1} h Z_{sc} T_{sc}}{p_{sc} T} \frac{p_{fn}^2 - p_{wf}^2}{\ln \frac{r_{fn}}{r_w}},$$

$$R_1 = \frac{p_{sc} T \bar{\mu} \bar{Z}}{\pi K_{fn} K_{rg1} h Z_{sc} T_{sc}} \ln \frac{r_{fn}}{r_w},$$

$$K_{fn} = \sum_{i=1}^{n} \frac{W_i^4 \cos^2 \gamma_i}{12X(W_i + X)} + \sum_{i=1}^{n} \frac{X_i}{W_i + X} K_m,$$

$$r_{fn} = \sqrt{a_{fn} b_{fn}},$$

$$S_w + S_g = 1;$$

and the model of water phase is:

$$p_{fn} - p_{wf} = \frac{\mu_w x_f}{K_{fn} K_{rw1} 2wh} q_w + \frac{4.405 \times 10^{-5}}{(K_{fn} K_{rw1})^{1.105}} \frac{\rho_w x_f}{4w^2 h^2} q_w^2;$$

wherein, $q_{sc1}$ is a flow rate of gas well of the strongly transformed area under standard condition, $m^3/s$;

$p_{fn}$ is a pressure at an interface of the strongly transformed area and the weakly transformed area, MPa;

$p_{wf}$ is bottom hole flow pressure, MPa;

$K_{fn}$ is a permeability of crack network of the strongly transformed area, mD;

$K_{rg1}$ is a relative permeability of gas-phase of the strongly transformed area, mD;

$K_m$ is matrix permeability, mD;

h is a thickness of the gas layer, m;

$Z_{sc}$ is a gas compression factor under standard condition, dimensionless;

$\bar{Z}$ is a gas compression factor under average pressure condition, dimensionless;

$T_{sc}$ is a temperature under standard condition, K;

T is a temperature under the formation condition, K;

$R_1$ is an equivalent seepage resistance of the strongly transformed area, MPa·s/$m^3$;

$p_{sc}$ is a pressure constant under standard condition, namely, 0.1 MPa;

$\bar{\mu}$ is a gas viscosity under average pressure condition, mPa·s;

$r_w$ is a radius of the gas well, m;

$r_{fn}$ is an equivalent supply radius, m;

$a_{fn}$ is a major axis of a fracturing ellipse of the strongly transformed area, m;

$b_{fn}$ is a minor axis of the fracturing ellipse of the strongly transformed area, m;

X is an average distance between each series of cracks, m;

W is crack opening, m;

γ is an angle formed by the pressure gradient direction and respective crack direction;

$S_w$ is water phase saturation, dimensionless;

$S_g$ is gas-phase saturation, dimensionless;

$\mu_w$ is the viscosity of water, mPa·s;

$x_f$ is main crack length, m;

$K_{rw1}$ is a relative permeability of water of the strongly transformed area, dimensionless;

w is crack width, m;

$\rho_w$ is density of water, kg/$m^3$; and $q_w$ is a water flow of the strongly transformed area under standard condition, $m^3/s$;

wherein, the standard condition is a condition that the pressure is 0.1 MPa; and a certain physical quantity under the average pressure condition is an average value of the physical quantity under different pressures within the range of bottom hole pressure variation.

14. The device for developing shale gas by tapered gradient pressure drop with multi-stage fractured horizontal well according to claim 13, characterized in that, the pressure difference-flow models of gas-phase and water phase of the weakly transformed area are as follows:

according to spatial heterogeneity of the fractured weakly transformed area, the permeability of the fractured weakly transformed area is corrected:

$$K_{mf} = \frac{K_{fn} - K_m}{r_{fn} - r_{mf}} r + \left( K_{fn} - \frac{K_{fn} - K_m}{r_{fn} - r_{mf}} r_{fn} \right);$$

the model of gas-phase is:

$$q_{sc2} = \frac{2\pi \frac{(K_{fn} - K_m) K_{rg2}}{r_{mf}} h Z_{sc} T_{sc} (p_{mf}^2 - p_{fn}^2)}{p_{sc} T \bar{\mu} \bar{Z} \left( 1 - 1 \Big/ \sqrt{\frac{2r_{mf}^2 + \sqrt{4r_{mf}^4 + a_{fn}^4}}{a_{fn}^2}} \right)} + \frac{2\pi K_{fn} K_{rg2} h Z_{sc} T_{sc} (p_{mf}^2 - p_{fn}^2)}{p_{sc} T \bar{\mu} \bar{Z} \ln \left( \frac{2r_{mf}^2 + \sqrt{4r_{mf}^4 + a_{fn}^4}}{a_{fn}^2} \right)},$$

$$R_{21} = \frac{p_{sc} T \bar{\mu} \bar{Z} \left( 1 - 1 \Big/ \sqrt{\frac{2r_{mf}^2 + \sqrt{4r_{mf}^4 + a_{fn}^4}}{a_{fn}^2}} \right)}{2\pi \frac{(K_{fn} - K_m) K_{rg2}}{r_{mf}} h Z_{sc} T_{sc}},$$

$$R_{22} = \frac{p_{sc} T \bar{\mu} \bar{Z} \ln \left( \frac{2r_{mf}^2 + \sqrt{4r_{mf}^4 + a_{fn}^4}}{a_{fn}^2} \right)}{2\pi K_{fn} K_{rg2} h Z_{sc} T_{sc}},$$

$$r_{mf} = \sqrt{a_{mf} b_{mf}},$$

$$S_w + S_g = 1;$$

and the model of water phase is:

$$p_{mf} - p_{fn} = \frac{q_w \mu_w}{8x_f h K_{mf} K_{rw2}(\arctan(\zeta_{mf}) - \arctan(\zeta_{fn}))} + G_W(\zeta_{mf} - \zeta_{fn});$$

wherein, $q_{sc2}$ is a flow rate of gas well of the weakly transformed area under standard condition, $m^3/s$;

$p_{fn}$ is a pressure at the interface of the strongly transformed area and the weakly transformed area, MPa;

$p_{mf}$ is a pressure at an interface of the weakly transformed area and the matrix area, MPa;

$K_m$ is a permeability of the matrix area, $m^2$;

$r_{mf}$ is an equivalent supply radius of the weakly transformed area, m;

r is an effective utilization radius, m;

$K_{rg2}$ is a relative permeability of gas-phase of the weakly transformed area, dimensionless;

$R_{21}$ is an additional resistance to consider spatial heterogeneity in the weakly transformed area, $MPa \cdot s/m^3$;

$R_{22}$ is an inherent resistance of the weakly transformed area, $MPa \cdot s/m^3$;

$a_{mf}$ is a major axis of a fracturing ellipse of the weakly transformed area, m;

$b_{mf}$ is a minor axis of the fracturing ellipse of the weakly transformed area, m;

$G_W$ is a starting pressure gradient, namely, the pressure gradient at which shale gas starts to flow, MPa/m;

$K_{rw2}$ is a relative permeability of water of the weakly transformed area, dimensionless;

$\zeta_{mf}$ is an value corresponding to $r_{mf}$ in elliptical coordinate system, m; and $\zeta_{fn}$ is an value corresponding to $r_{fn}$ in elliptical coordinate system, m.

15. The device for developing shale gas by tapered gradient pressure drop with multi-stage fractured horizontal well according to claim 14, characterized in that, the pressure difference-flow models of gas-phase and water phase of the matrix area are as follows:

the model of gas-phase is:

$$a_e = a_{mf}\left[\frac{1}{2} + \sqrt{\frac{1}{4} + \left(\frac{r_e}{a_{mf}}\right)^4}\right]^{\frac{1}{2}},$$

$$q_{sc3} = \frac{4\pi K_m K_{rg3} h Z_{sc} T_{sc}}{p_{sc} T \overline{\mu} \overline{Z} \ln\left(\frac{2r_e^2 + \sqrt{4r_e^4 + a_e^4}}{a_e^2}\right)} \times \left[\frac{p_e^2 - p_{mf}^2}{2} + \frac{3\pi\alpha\overline{\mu}D}{16K_m K_{rg3}}(p_e - p_{mf})\right],$$

$$R_3 = \frac{p_{sc} T \overline{\mu} \overline{Z} \ln\left(\frac{2r_e^2 + \sqrt{4r_e^4 + a_e^4}}{a_e^2}\right)}{4\pi K_m K_{rg3} h Z_{sc} T_{sc}},$$

$$S_w + S_g = 1;$$

and the model of water phase is:

$$p_e - p_{mf} = \frac{q_w \mu_w}{2\pi h K_m K_{rw3} \ln \frac{r_e}{r_{mf}}} + G_w(r_e - r_{mf});$$

wherein, $q_{sc3}$ is a flow rate of gas well of the matrix area under standard condition, $m^3/s$;

$p_e$ is a pressure outside the matrix area, Mpa;

$a_e$ is a major axis of a matrix ellipse seepage area, m;

$K_{rg3}$ is a relative permeability of gas-phase of the matrix area, dimensionless;

$r_e$ is an exploiting radius of the gas well, m;

D is a diffusion coefficient, $cm^2/s$;

α represents a correction coefficient related to Knudsen number $K_n$, and $\alpha=0(0 \le K_b < 0.001)$, $\alpha=1.2(0.001 \le K_n < 0.1)$, $\alpha=1.34(0.1 \le K_n < 10)$; and $K_{rw3}$ is a relative permeability of water of the matrix area, dimensionless.

16. The device for developing shale gas by tapered gradient pressure drop with multi-stage fractured horizontal well according to claim 15, characterized in that, said couple the pressure difference-flow models of gas-phase and water phase of the strongly transformed area, the pressure difference-flow models of gas-phase and water phase of the weakly transformed area and the pressure difference-flow models of gas-phase and water phase of the matrix area, so as to establish a production equation of the multi-stage fractured horizontal well comprises:

couple the pressure difference-flow models of gas-phase and water phase of the strongly transformed area, the pressure difference-flow models of gas-phase and water phase of the weakly transformed area and the pressure difference-flow models of gas-phase and water phase of the matrix area by equal seepage resistance method, and establish the production equation of the multi-stage fractured horizontal well based on diffusion and desorption of the shale gas reservoir.

17. The device for developing shale gas by tapered gradient pressure drop with multi-stage fractured horizontal well according to claim 16, characterized in that, the production equation of the multi-stage fractured horizontal well is as follows:

the model of gas-phase is $$q_{sc} = \frac{p_e^2 - p_{wf}^2}{R_1 + R_2 + 2R_3} + \frac{2A(p_e - p_{mf})}{R_1 + R_2 + 2R_3} + \frac{2R_3 q_d}{R_1 + R_2 + 2R_3},$$

$$p_{mf} = \frac{-A(R_1 + R_2) + \sqrt{A^2(R_1 + R_2)^2 + B(R_1 + R_2 + 2R_3)}}{R_1 + R_2 + 2R_3},$$

$$R_2 = \frac{R_{21} R_{22}}{R_{21} + R_{22}},$$

$$A = \frac{3\pi\alpha\overline{\mu}D}{16K_m},$$

$$B = (R_1 + R_2)p_e^2 + 2A(R_1 + R_2)p_e + 2R_3 p_{wf}^2 + 2R_3 q_d(R_1 + R_2),$$

$$q_d = \pi(r_e^2 - r_w^2)h\rho_m\left(V_m \frac{p_e}{p_L + p_e} - V_m \frac{\overline{p}}{p_L + \overline{p}}\right) - \pi(r_e^2 - r_w^2)\phi_m;$$

and the model of water phase is $$p_e - p_{wf} = \frac{\mu_w x_f}{K_{fn} K_{rw1} 2wh} q_w + \frac{4.405 \times 10^{-5}}{(K_{fn} K_{rw1})^{1.105}} \frac{\rho_w x_f}{4w^2 h^2} q_w^2 + \frac{q_w \mu_w}{8x_f h K_{mf} K_{rw2}(\arctan(\zeta_{mf}) - \arctan(\zeta_{fn}))} + G_w(\zeta_{mf} - \zeta_{fn}) + \frac{q_w \mu_w}{2\pi h K_m K_{rw3} \ln \frac{r_e}{r_{mf}}} + G_w(r_e - r_{mf});$$

wherein, $q_d$ is a desorption gas volume of matrix, $m^3/s$;

$q_{sc}$ is a gas well flow rate after coupling the three areas, m3/s;

$\rho_m$ is rock skeleton density, $kg/m^3$;

$r_w$ is an radius of the gas well, m;

$V_m$ is Langmuir isothermal adsorption constant, $cm^3/g$;

$\phi_m$ is matrix porosity;

$p_L$ is Langmuir pressure constant, MPa; and $\bar{p}$ is an average pressure of the formation, MPa.

18. The device for developing shale gas by tapered gradient pressure drop with multi-stage fractured horizontal well according to claim 11, characterized in that, the fracturing crack form parameters comprise: main crack length, crack opening, crack width, and average distance between each series of cracks.

19. The device for developing shale gas by tapered gradient pressure drop with multi-stage fractured horizontal well according to claim 11, characterized in that, the reservoir characteristic parameters comprise: temperature under formation condition, gas layer thickness, rock skeleton density, matrix porosity, matrix permeability, average formation pressure, and pressure outside the matrix area.

20. The device for developing shale gas by tapered gradient pressure drop with multi-stage fractured horizontal well according to claim 11, characterized in that, said according to the gas production curves, select a combination of production pressure differences as combination of production pressure differences of the multi-stage fractured horizontal well comprises:

according to the gas production curves, select a combination of production pressure differences corresponding to a gas production curve with maximum cumulative gas production as the combination of production pressure differences of the multi-stage fractured horizontal well.

* * * * *